US007509945B2

(12) United States Patent
Teets et al.

(10) Patent No.: US 7,509,945 B2
(45) Date of Patent: Mar. 31, 2009

(54) FUEL PUMP SPEED CONTROL SYSTEM

(75) Inventors: Michael R. Teets, Grosse Pointe Park, MI (US); Trevor L. Enge, West Bloomfield, MI (US); Lavern M. Bremmer, Dexter, MI (US); Jon R. Donegan, Davisburg, MI (US); Greg Schoenberg, St. Louis, MO (US)

(73) Assignee: Chrysler LLC, Auburn Hills, MI (US)

( * ) Notice: Subject to any disclaimer, the term of this patent is extended or adjusted under 35 U.S.C. 154(b) by 200 days.

(21) Appl. No.: 11/686,594

(22) Filed: Mar. 15, 2007
(Under 37 CFR 1.47)

(65) Prior Publication Data

US 2008/0202476 A1 Aug. 28, 2008

Related U.S. Application Data

(60) Provisional application No. 60/782,421, filed on Mar. 15, 2006.

(51) Int. Cl.
*F02M 37/04* (2006.01)
*F02M 51/00* (2006.01)

(52) U.S. Cl. ..... 123/497; 123/494

(58) Field of Classification Search ..... 123/497, 123/494
See application file for complete search history.

(56) References Cited

U.S. PATENT DOCUMENTS

| | | | | | |
|---|---|---|---|---|---|
| 4,237,836 | A * | 12/1980 | Tanasawa et al. | ..... | 123/472 |
| 4,320,662 | A * | 3/1982 | Schaub et al. | ..... | 73/660 |
| 4,577,604 | A | 3/1986 | Hara et al. | | |
| 4,800,859 | A | 1/1989 | Sagisaka et al. | | |
| 4,940,034 | A | 7/1990 | Heim et al. | | |
| 5,113,621 | A * | 5/1992 | Grimes | ..... | 451/14 |
| 5,513,614 | A * | 5/1996 | Gras et al. | ..... | 123/497 |
| 6,087,796 | A * | 7/2000 | Canada et al. | ..... | 318/565 |
| 6,223,731 | B1 * | 5/2001 | Yoshiume et al. | ..... | 123/497 |
| 6,453,878 | B1 * | 9/2002 | Mazet | ..... | 123/497 |
| 6,932,055 | B2 * | 8/2005 | Rado | ..... | 123/352 |

* cited by examiner

*Primary Examiner*—Thomas N Moulis
(74) *Attorney, Agent, or Firm*—Ralph E. Smith

(57) ABSTRACT

A fuel pump controller includes a detecting device for detecting environmental vibrational energy and converting the environmental vibrational energy into an electrical signal. A motor controller is coupled to a fuel pump motor wherein the electrical signal is used by the controller to command the fuel pump motor to operate at one of a plurality of speeds wherein the commanded speed is at least in part a function of the environmental vibrational energy.

20 Claims, 3 Drawing Sheets

FUEL PUMP SPEED CONTROL SYSTEM

CROSS-REFERENCE TO RELATED APPLICATIONS

This application claims the benefit of U.S. Provisional Application No. 60/782,421, filed on Mar. 15, 2006. The disclosure of the above application is incorporated herein by reference.

TECHNICAL FIELD

This application generally relates to vehicle fuel delivery systems and more particularly relates to control systems for variable speed fuel pumps.

BACKGROUND

Vehicle fuel pump systems commonly employ an electric motor coupled to a mechanical pump for pumping fuel from a fuel reservoir to an engine. Although it is possible to simplify the fuel system controls by operating the electric motor at a sufficiently high speed such that the pump will meet the greatest, fuel demand imposed by the engine, such a simplistic approach may degrade the fuel efficiency of the vehicle (by wasting electrical energy) and adversely effects the life expectancy of the components in the fuel delivery system. In order to operate a fuel delivery system as efficient as possible, it is common for the fuel control system to monitor one or more engine parameters indicative of the real time fuel demand of the engine. Under this controlled, approach, the fuel control system can operate the motor at slower speeds when the fuel demand of the engine is minimal or moderate and the control system can operate the pump motor at higher speeds when the fuel consumption demand of the engine is high. Although such control systems are effective for enhancing the efficiency and life expectancy of the components of the fuel delivery system, they require extra complexity, such as tying the fuel delivery system to the engine or engine control system. This complexity not only increases development costs, but it also increases the cost of implementing the system inasmuch as additional electrical conductors, connectors, and other components must be incorporated into the fuel delivery system.

The present invention provides, among other things, a variable speed motor coupled to a fuel pump, without requiring interconnection of the fuel system to the engine or engine control system for sensing the fuel demands of the engine.

DETAILED DESCRIPTION

Figure 1:
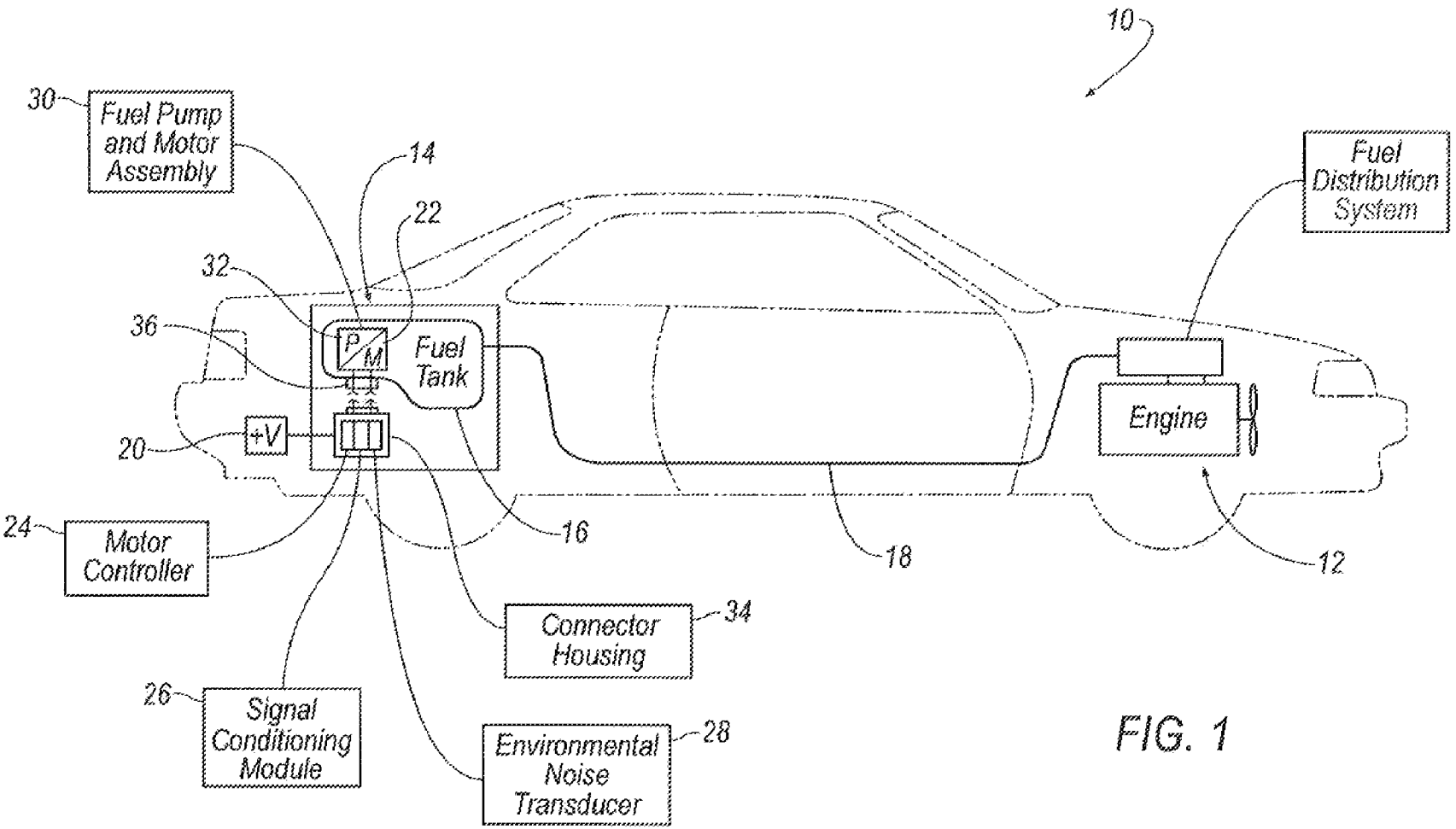
FIG. 1 is a diagrammatic view of a vehicle employing an embodiment of the fuel pump speed control system of the present invention.

Now referring to FIG. 1, vehicle 10 employs engine 12 for propelling vehicle 10 and fuel system 14 for storing and pumping fuel from fuel tank 16 to engine 12 by way of fuel delivery conduit 18. Although much of the description herein primarily focuses on the delivery of liquid fuels to engine 12, nothing herein is meant to limit the present invention to liquid fuel delivery systems. Fuels in gaseous, or even semi-solid states could also be delivered using the present invention.

Fuel system 14 may use electric power provided from power source 20 (typically a battery or the like), to provide electrical operating power to motor 22 and to the electrical components (motor controller 24, signal conditioning module 26, and possibly environmental noise transducer 28) used to control the speed of motor 22. Fuel pump 32 and motor 22 may be packaged together 30 and reside within a fuel storage cavity of fuel tank 16. Although this packaging methodology is common, nothing in the present invention is limited to only this packaging convention and the present invention may be used in systems where only one of the pump 32 or the motor 22 resides within the fuel storage cavity of the fuel tank 16. It is also possible to locate both the fuel pump 30 and the motor 22 outside of the fuel tank 16 and rely on gravity or other means (such as a pump vacuum) to deliver the fuel from fuel tank 16 to pump 32.

Motor controller 24, signal conditioning module 26, and, if included, an environmental noise transducer 28, can reside in any portion of the vehicle and still function to carry out an embodiment of the present invention. However, for many embodiments, it may be advantageous to fit all three components (motor controller 24, signal conditioning module 26, and environmental noise transducer 28) within a single connector housing 34 which may, in turn, function as an electrical connector to mate with a receiving/mating electrical connector 36. Connector 36 conveys appropriate electrical signals from connector 34 to motor 22. By integrating motor controller 24, signal conditioning module 26, and, if present, an environmental noise transducer 28, within a single connector housing 34, most of the electrical components that comprise fuel system 14 are conveniently located in a single wiring connector 34. This packaging approach not only minimizes the handling and inventorying of numerous, discrete components, it also minimizes electrical connections that would otherwise be exposed to environmental conditions that might eventually compromise the operation of motor controller 24, signal conditioning module 26, or environmental noise transducer 28.

Figure 2:
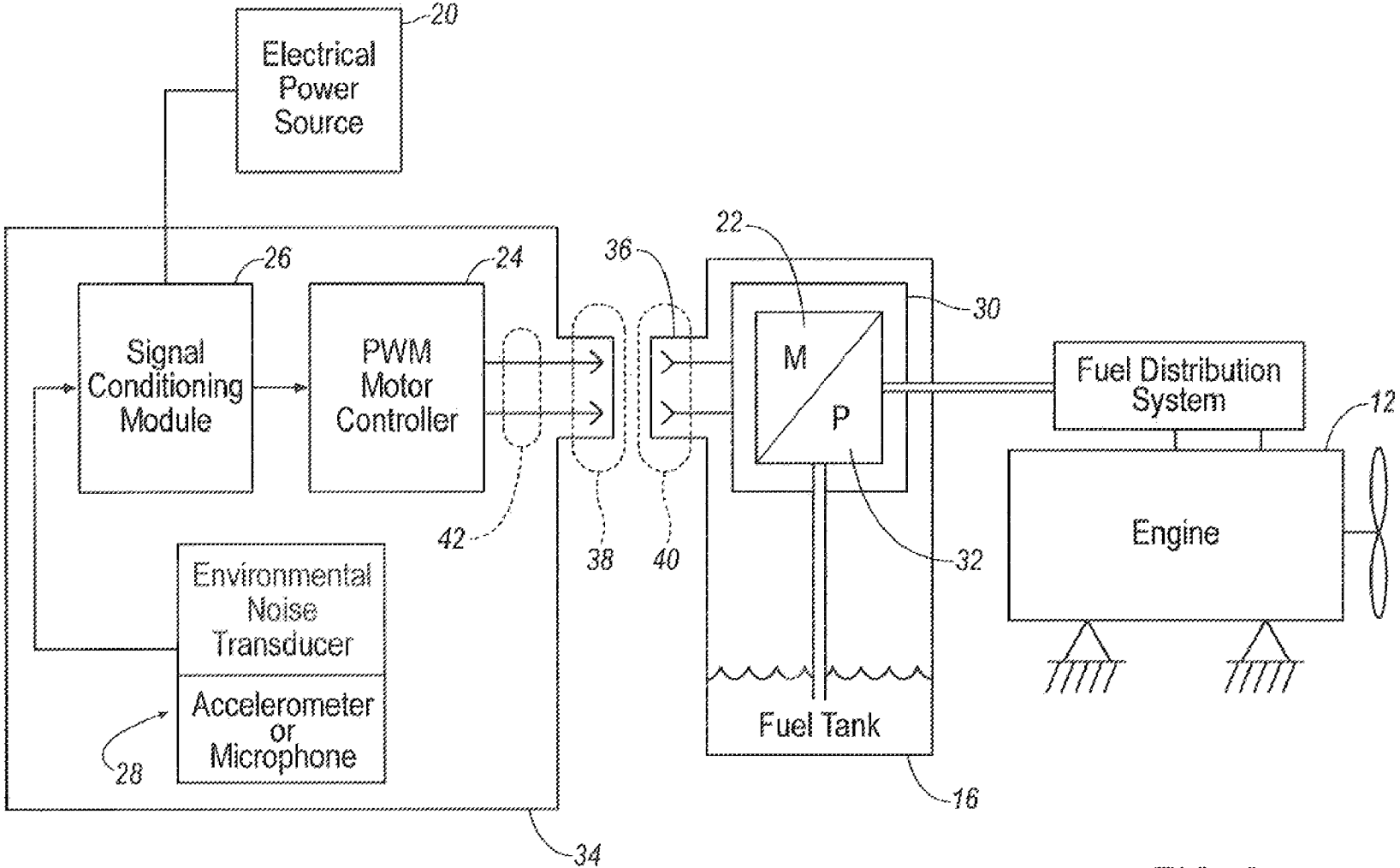
FIG. 2 is a diagrammatic view of an embodiment of the fuel pump speed control system of the present invention.

Now referring to FIG. 1 and FIG. 2, connector 34 may include interface portion 38 which is adapted to receivingly mate with interface portion 40 of connector 36. Interface 38 may carry all of the electrical conductors which are necessary for the operation of fuel pump and motor assembly 30. Connector 34 includes, in an embodiment, an environmental transducer 28 for converting environmental noise or vibration to an electrical signal. Transducer 28, in one embodiment, can be any type of detecting device for detecting environmental vibrational energy associated with a vehicle state, such as a microphone for picking up ambient, road noise associated with the vehicle as the vehicle traverses the road. In another embodiment, transducer 28 can include an accelerometer for picking up vehicle vibration imparted to an accelerometer during vehicle operation. In many instances, the combination of one or more engine noise, drivetrain noise, or road noise picked up by environmental noise transducer 28 can be used as an accurate proxy for engine fuel demand. Specifically, under many vehicle operating conditions, there is a positive correlation between environmental vibrational energy and fuel demand. Accordingly, in order to satisfy the fuel demands of engine 12 during a high fuel demand mode of operation, the signal generated by environmental noise transducer 28 can be sent directly to controller 24 as a means of measuring fuel demand. In some applications it may be advantageous to electronically condition the transducer 28 signal by way of a signal conditioning module 26 for filtering, amplifying, or the like prior to sending it to controller 24.

The output 42 of motor controller 24 may be directly coupled to motor 22 (by way of connector 36) and it is used to control the speed of fuel pump motor 22. Motor controller 24 may be of the type that employs pulse width modulation (hereinafter PWM) motor control. However, other motor control methodologies known to those skilled in the art may also be used to control the rotational speed of motor 22.

Now referring to FIG. 3, the present invention can be implemented using any number of discrete speed settings for fuel pump and motor assembly 30; however, the present invention will now be discussed in the context of two discrete motor speed command settings.

In instances where the output signal of environmental noise transducer 28 (after it is conditioned by module 26) is below a preset noise threshold level (such as depicted at $t_1$ in FIG. 3), the output 42 of motor controller 26 may be maintained at a first level ($SP_1$) such that fuel pump and motor assembly 30 rotate at a first speed which is sufficient to meet the low and moderate fuel demands of engine 12.

Figure 3:
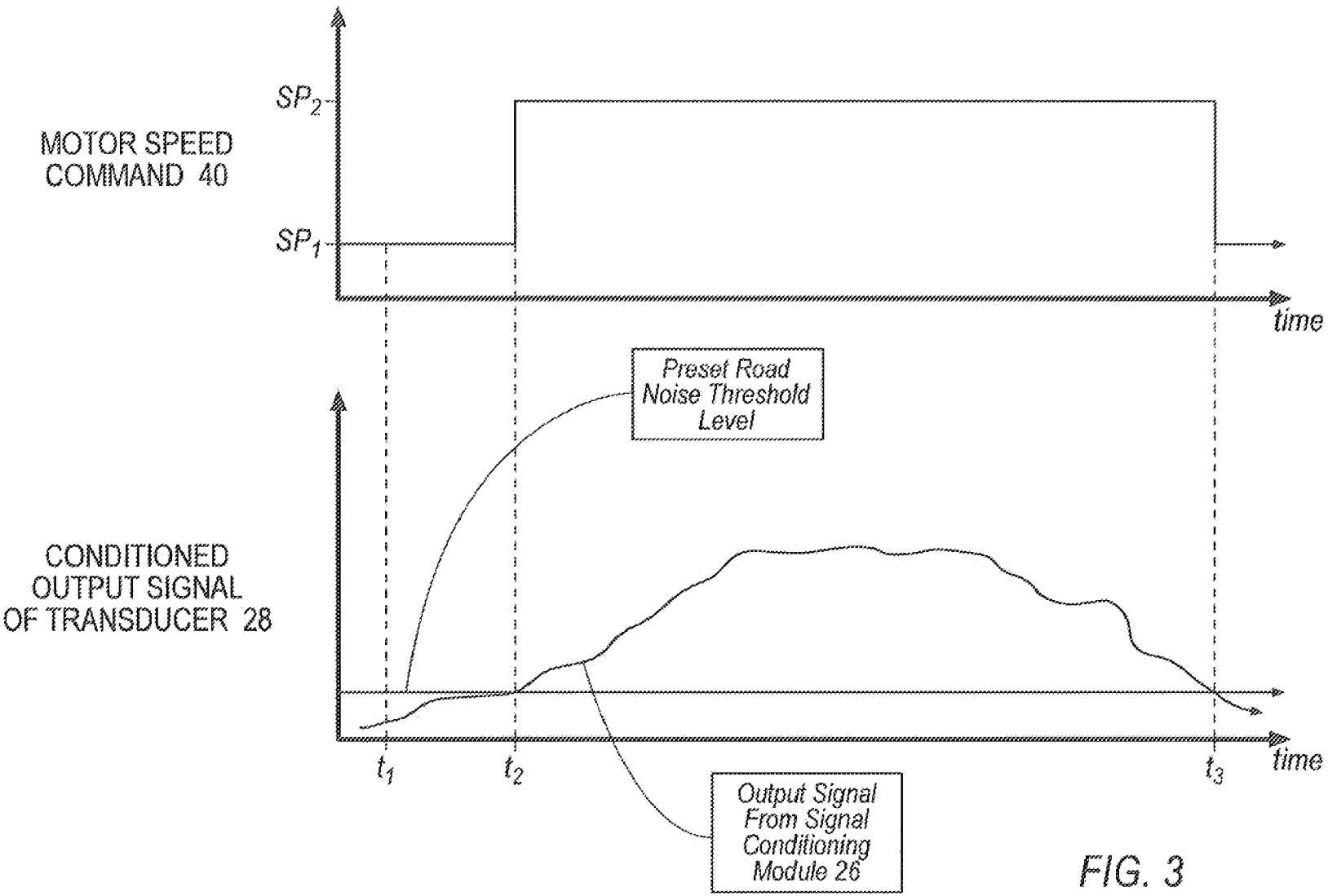
FIG. 3 is a graphical representation of an interaction between a signal derived from an environmental noise transducer and a road noise threshold level signal.

In periods of operation when engine 12 is required to deliver more horsepower, the output signal from signal conditioning module 26 will cross (shown at $t_2$), and reside above preset road noise threshold level (see the time duration span between $t_2$ and $t_3$ in FIG. 3). During the time when the output signal from signal conditioning module 26 is above preset road noise threshold level, the output signal generated by controller 24 is adjusted upward to a level indicated by $SP_2$. The $SP_2$ level indicates a motor speed command that is greater than that commanded at the $SP_1$ level. This increased command will cause fuel pump motor and pump assembly 30 to rotate at a higher speed enabling greater fuel volume rates to be delivered to engine 12. Once the conditioned output signal from signal conditioning module 26 returns below the preset road noise threshold level (depicted by the cross over at $t_3$), motor controller 24, once again, issues an output signal at the $SP_1$ signal at its output 42 thereby commanding fuel pump and motor assembly 30 to rotate at a slower speed (thereby conserving energy costs associated with running the fuel pump motor 30 at higher speeds). By following the control methodology of FIG. 3, the fuel pump will deliver fuel at a rate that is a function of (or is correlated to) engine demand.

Although the present invention has been discussed in the context of operating fuel pump motor and pump assembly 30 at two operational speeds (i.e. $SP_1$, and $SP_2$), it is fully contemplated that three or more command speeds may be used for carrying out the invention and that improved efficiencies may be realized by using three or more motor speed command levels. Additionally, although an embodiment of the present invention has been discussed in the context of using discrete steps between motor speed command $SP_1$ and motor speed command $SP_2$, it is contemplated that the differences between adjacent, discrete steps can be made infinitesimally small such that the motor speed command achieved at output 42 allows infinitely variable (or near infinitely variable) speed adjustment for fuel pump motor and pump assembly 30.

Having described various embodiments of the present, invention, it will be understood that various modifications or additions may be made to the embodiments illustrated herein without departing from the spirit of the present invention. For example, environmental transducer 28 has been disclosed herein in the form of a microphone, an accelerometer, or combinations of the two. However, it is contemplated that other types of environmental transducers can be used for carrying out the present invention. Accordingly, it is to be understood that the subject, matter sought to be afforded protection hereby shall be deemed to extend to the subject matter defined in the appended claims, including all fair equivalents thereof.

What is claimed:

1. A fuel pump controller, comprising:

a detecting device for detecting environmental vibrational energy and converting the environmental vibrational energy to an electrical signal, a motor controller coupled to a fuel pump motor, wherein the electrical signal is coupled to the controller and it is used by the controller to command the fuel pump motor to operate at one of a plurality of speeds, wherein said commanded speed is at least in part correlated to the environmental vibrational energy.

2. The controller of claim 1, wherein said detecting device and said motor controller are provided in a common housing.

3. The controller of claim 2, wherein the common housing is an electrical connector.

4. The controller of claim 3, wherein the electrical connector is adapted to be mated to a connector for a fuel pump motor and pump assembly.

5. The controller of claim 1, further including a signal conditioning module coupled between the detecting device and the motor controller.

6. The controller of claim 5, wherein said signal conditioning module includes an amplifier.

7. The controller of claim 5, wherein said signal conditioning filter contains at least one electrical filter component.

8. The controller of claim 1, wherein said motor controller is a pulse width motor controller.

9. The controller of claim 1, wherein said detecting device is a microphone.

10. The controller of claim 1, wherein said detecting device is an accelerometer.

11. A vehicle fuel pump speed control, comprising:

a transducer for detecting environmental noise, wherein said transducer converts the environmental noise to an electrical transducer output signal, wherein said electrical transducer output signal is indicative of the environmental noise, a signal conditioning module electrically coupled to the electrical transducer output signal for conditioning said electrical transducer output signal to produce an electrical conditioned output signal, a motor controller electrically coupled to said electrical conditioned output signal, wherein said electrical conditioned electrical signal is used by the motor controller to command an electrical fuel pump motor to rotate at a speed that is at least in part correlated to the environmental noise.

12. The vehicle fuel pump speed control system of claim 11, further including a fuel pump mechanically coupled to said fuel pump motor, wherein said fuel pump and said fuel pump motor are located within a cavity defined at least in part by a fuel tank.

13. The vehicle fuel pump speed control system of claim 11, wherein said transducer, signal conditioning module, and said motor controller are collectively provided in a common housing.

14. The vehicle fuel pump speed control system of claim 13, wherein the common housing is an electrical connector.

15. The vehicle fuel pump speed control system of claim 14, wherein the electrical connector is mated to a connector for said fuel pump motor.

16. The vehicle fuel pump speed control system of claim 11, wherein said motor controller is a pulse width motor controller.

17. The vehicle fuel pump speed control system of claim 11, wherein said signal conditioning module contains at least one electrical filter component.

18. A method for controlling a speed of a fuel pump motor, comprising:

detecting vibrational energy associated with a vehicle's state, converting the detected vibrational energy into an electrical signal that, is indicative of said detected vibrational energy, using said electrical signal to control a speed of a fuel pump motor in a way that a fuel demand of a vehicle coupled to the fuel pump motor may be met.

19. The method of claim 18, wherein a microphone is used to detect the vibrational energy associated with the vehicle's state.

20. The method of claim 18, wherein and accelerometer is used to detect the vibrational energy associated with the vehicle's state.

* * * * *